US009434451B1

(12) United States Patent
Ostmeyer et al.

(10) Patent No.: US 9,434,451 B1
(45) Date of Patent: Sep. 6, 2016

(54) FOLDING WATERSPORTS TOWER

(71) Applicant: Xtreme Marine Corporation, Maryville, TN (US)

(72) Inventors: Matthew Ostmeyer, Maryville, TN (US); Bradley Michael Nemeth, Oak Ridge, TN (US)

(73) Assignee: Xtreme Marine Corporation, Maryville, TN (US)

( * ) Notice: Subject to any disclaimer, the term of this patent is extended or adjusted under 35 U.S.C. 154(b) by 0 days.

(21) Appl. No.: 14/804,744

(22) Filed: Jul. 21, 2015

Related U.S. Application Data

(63) Continuation-in-part of application No. 14/207,960, filed on Mar. 13, 2014, now Pat. No. 9,114,855, and a continuation-in-part of application No. 13/963,603, filed on Aug. 9, 2013, now Pat. No. 9,114,854.

(60) Provisional application No. 62/135,926, filed on Mar. 20, 2015.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 21/56; B63B 21/58
USPC ..... 114/253, 361
See application file for complete search history.

(56) References Cited

U.S. PATENT DOCUMENTS 4,926,782 A 5/1990 Lacy
5,044,298 A * 9/1991 Pepper ..... B63B 17/02 114/361
5,918,613 A 7/1999 Larson
6,026,761 A 2/2000 Parniske et al.
6,209,477 B1 4/2001 Biedenweg
6,257,261 B1 7/2001 Johnson
6,327,993 B1 12/2001 Richens
6,666,159 B2 12/2003 Larson
6,691,637 B1 2/2004 Smith
6,755,332 B2 6/2004 Crane
6,799,529 B1 10/2004 Willis
6,945,188 B2 9/2005 Eck
6,983,716 B1 1/2006 Ankney et al.
7,013,830 B1 3/2006 Willis
7,392,758 B2 7/2008 Metcalf
7,438,015 B1 10/2008 Schwindaman
(Continued)

*Primary Examiner* — Lars A Olson

(74) *Attorney, Agent, or Firm* — Luedeka Neely Group, P.C.

(57) ABSTRACT

A foldable watersports tower mountable on a boat and suitable to serve as both a watersports tower and provide support for a sun cover. The tower includes a cover frame and a leg supporting the cover frame. The leg includes a first leg section having a lower end and an upper end. The lower end of the first leg section is pivotally mountable adjacent the boat at a first lower pivot location, and the upper end of the first leg section is pivotally connected to the cover frame at a first upper pivot location. The leg includes a second leg section having a lower end and an upper end. The lower end of the second leg section is pivotally mountable adjacent the boat at a second lower pivot location. The upper end of the second leg section is pivotally connected to the cover frame at a second upper pivot location. The tower is foldable so as to be raisable and lowerable between a raised position and a lowered position and the cover frame is capable of remaining in a constant attitude as the tower travels between the raised position and the lowered position.

16 Claims, 23 Drawing Sheets

(56) References Cited

U.S. PATENT DOCUMENTS

| | | | | |
|---|---|---|---|---|
| 7,895,964 | B2 | 3/2011 | Russikoff | |
| 7,950,342 | B2 | 5/2011 | Russikoff | |
| 8,025,194 | B2 | 9/2011 | Jesewitz | |
| 8,297,484 | B2 | 10/2012 | Jesewitz | |
| 8,495,967 | B2 * | 7/2013 | Williams | B63B 17/02 114/253 |
| 8,567,651 | B2 | 10/2013 | Jesewitz | |
| 8,752,498 | B1 | 6/2014 | Schwindaman et al. | |
| 9,114,854 | B2 * | 8/2015 | Williams | B63B 17/02 |
| 9,114,855 | B2 * | 8/2015 | Nemeth | B63B 17/02 |
| 2005/0194414 | A1 | 9/2005 | Lynch | |
| 2012/0067269 | A1 | 3/2012 | Williams | |
| 2014/0261143 | A1 | 9/2014 | Williams et al. | |
| 2014/0261144 | A1 | 9/2014 | Nemeth | |

* cited by examiner

FOLDING WATERSPORTS TOWER

CROSS-REFERENCE TO RELATED APPLICATION

This application claims priority to U.S. Provisional Application Ser. No. 62/135,926 filed Mar. 20, 2015, entitled Folding Watersports Tower, and incorporated by reference herein in its entirety. This application is also a continuation-in-part application of co-pending application Ser. No. 14/207,960, filed Mar. 13, 2014, and a continuation-in-part of co-pending application Ser. No. 13/963,603, filed Aug. 9, 2013, both of which are hereby incorporated by reference in their entirety.

FIELD

The present disclosure relates to watersports towers for boats. More particularly, the disclosure relates to a watersports tower of folding construction configured to support a bimini cover and that is foldable to provide different configurations while maintaining the bimini cover in a constant attitude.

BACKGROUND

Improvement is desired in the provision of sun covers for boats. In particular, what is desired is a folding watersports tower incorporating a sun or other protective cover structure that is foldable to provide different configurations while maintaining the sun cover structure in a constant attitude.

SUMMARY

The disclosure advantageously provides a folding watersports tower structure that incorporates a sun cover structure, and is foldable to provide different configurations while maintaining the sun cover structure in a constant horizontal attitude.

Towers according to the disclosure allow for compact folding. The tower may be partially folded to allow access to cargo stowed on the sun cover without interfering with the windshield, seating, or other interior components of the boat. Also, when the tower is in the partially folded position, the boat can pass under low bridges common to canals and the like without causing substantial interference to passengers in the boat.

The tower may be further lowered to a fully folded position that does not interfere with the windshield, seating, or other interior components of the boat. The fully folded position is advantageous for low clearance situations as well as trailering and storage of the boat, such as to allow egress into a garage, while also providing the benefit of providing support for a boat cover.

In one aspect, the tower includes a cover frame and a leg supporting the cover frame. The leg includes a first leg section having a lower end and an upper end. The lower end of the first leg section is pivotally mountable adjacent the boat at a first lower pivot location, and the upper end of the first leg section is pivotally connected to the cover frame at a first upper pivot location.

The leg includes a second leg section having a lower end and an upper end. The lower end of the second leg section is pivotally mountable adjacent the boat at a second lower pivot location that is spaced apart from the first lower pivot location. The upper end of the second leg section is pivotally connected to the cover frame at a second upper pivot location that is spaced apart from the first upper pivot location.

The tower is foldable so as to be raisable and lowerable between a raised position and a lowered position and the cover frame remains in a constant attitude as the tower travels between the raised position and the lowered position.

In another aspect, the tower includes a cover frame having a frame base and a pivot base pivotally connected to the frame base, and a leg supporting the cover frame.

The leg includes a first leg section having a lower end and an upper end. The lower end of the first leg section is pivotally mountable adjacent the boat at a first lower pivot location, and the upper end of the first leg section is connected to the pivot base of the cover frame at a first upper pivot location.

The leg includes a second leg section having a lower end and an upper end. The lower end of the second leg section is pivotally mountable adjacent the boat at a second lower pivot location that is spaced apart from the first lower pivot location, and the upper end of the second leg section is pivotally connected to the frame base of the cover frame at a second upper pivot location that is spaced apart from the first upper pivot location.

The tower is foldable so as to be raisable and lowerable between a raised position and a lowered position and the cover frame remains in a constant attitude as the tower travels between the raised position and the lowered position.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Tower 10 Embodiment—FIGS. 1-24

Figure 1:
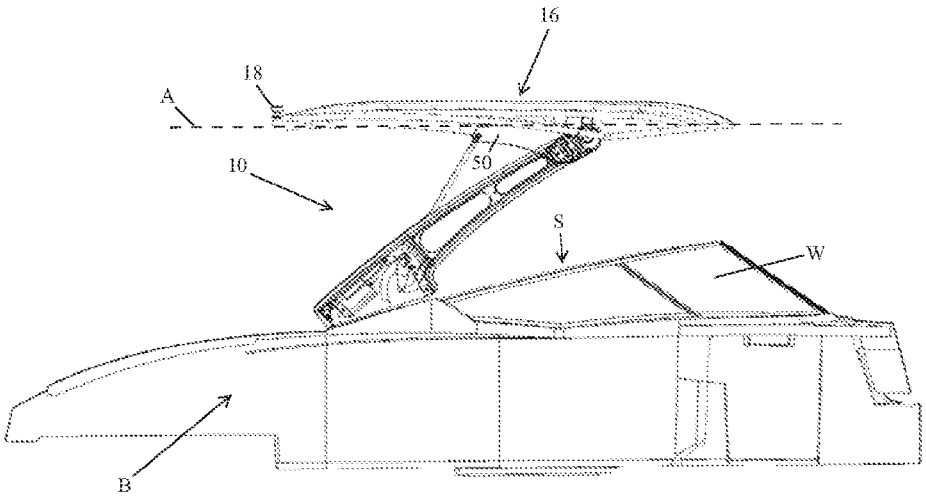
FIG. 1 shows a folding watersports tower according to the disclosure mounted on a boat and oriented in a fully elevated orientation.

With initial reference to FIGS. 1-24, there is shown a foldable watersports tower 10 according to the disclosure that is mountable on a boat B. The boat B includes a seating area S located generally behind and below a windshield W.

The tower 10 includes, as major components, a pair of folding leg structures 12 and 14 mounted onto opposite sides of the boat B, and a cover frame 16 that cooperates with and spans between the leg structures 12 and 14 and functions to provide a raised arch structure for supporting a raised tow point 18.

A bimini or other sun cover as may be provided by a cloth or other flexible sheet material may be secured onto, preferably overlying, the cover frame 16, and without interfering with the tow point 18. The cover frame 16 with or without the sun cover is suitable for use for storing cargo, such as ski ropes, wakeboards, and other water sports equipment. For example, straps may be used to secure cargo on top of the cover frame 16 and/or wakeboard racks and the like of the type typically installed onto wakeboard towers may be installed onto the cover frame 16.

The tower 10 is advantageously suitable to serve as both a watersports tower and provide support for a bimini cover, other sun or protective cover to protect occupants of the boat from the elements. Each of the leg structures 12 and 14 is pivotally mounted relative to the boat by a pair of offset pivot points, and each side of the cover frame 16 is pivotally mounted to one of the legs by a pair of offset pivot points. The spaced apart pivot points for each of the leg structures 12 and 14 and the cover frame 16 described herein are denoted by reference character P.

The described structure having the noted pairs of spaced apart pivot points advantageously enables the tower 10 to be foldable to provide different elevations or configurations while maintaining the cover frame 16 in a constant attitude. For example, FIG. 1 shows the frame 10 in a fully elevated orientation. This orientation is preferred for use of the boat for wakeboarding and the like. As will be observed, the cover frame 16 is oriented in a horizontal attitude, as represented by the dashed line A.

Figure 2:
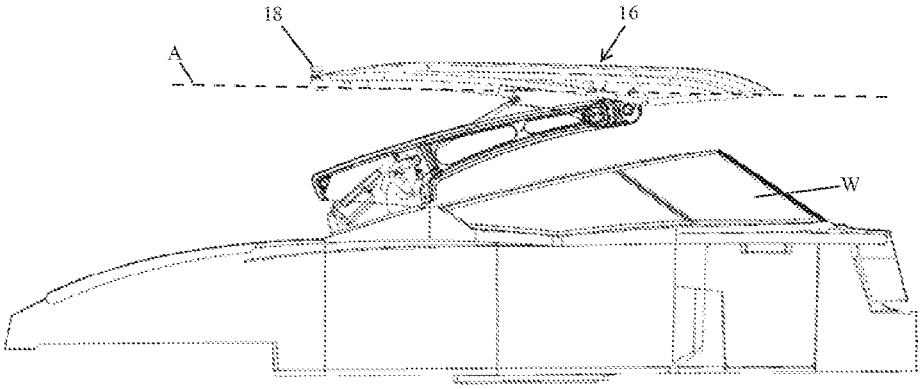
FIG. 2 shows the tower of FIG. 1 in a partially lowered orientation.

FIG. 2 shows the tower 10 in a partially lowered orientation. This orientation is preferred to enable access to retrieve cargo from the cover frame 16 or to load cargo onto the cargo frame. Also, in this orientation, the boat B may be able to pass under low bridges without causing substantial interference to passengers in the boat. As will be observed, the cover frame 16 remains oriented in the same horizontal attitude A as in the fully elevated orientation, and without interfering with the windshield W, seating S, or other interior components of the boat B.

Figure 3:
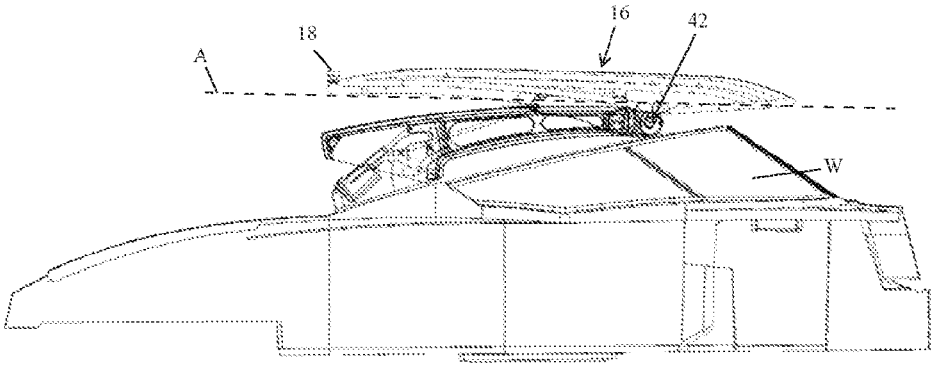
FIG. 3 shows the tower of FIG. 1 in a fully lowered orientation.
Figure 4:
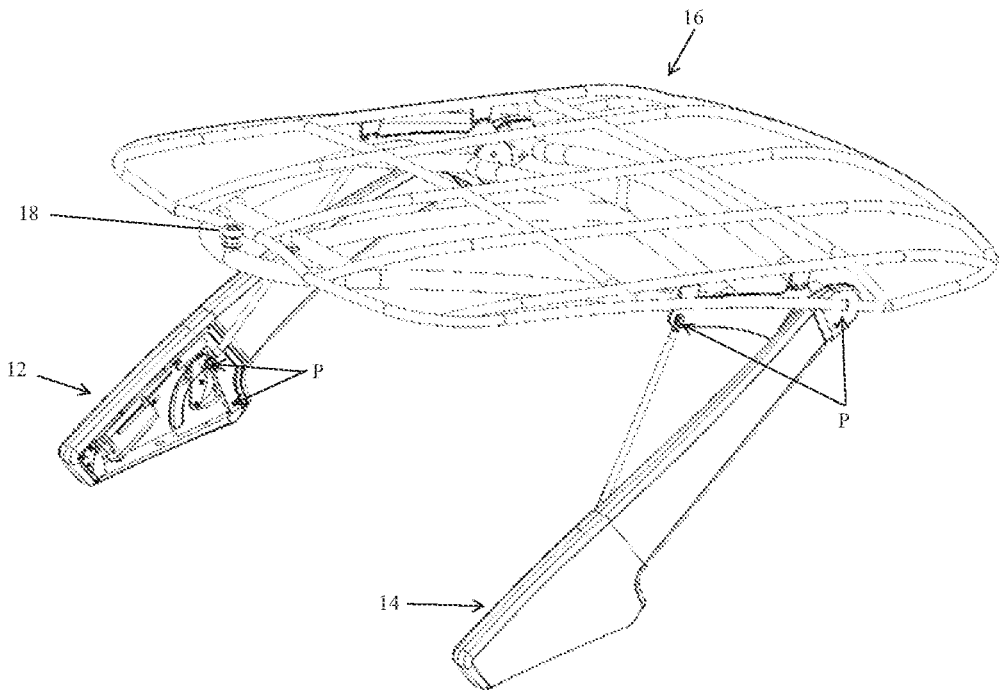
FIGS. 4 and 5 are perspective views of the tower of FIG. 1.
Figure 5:
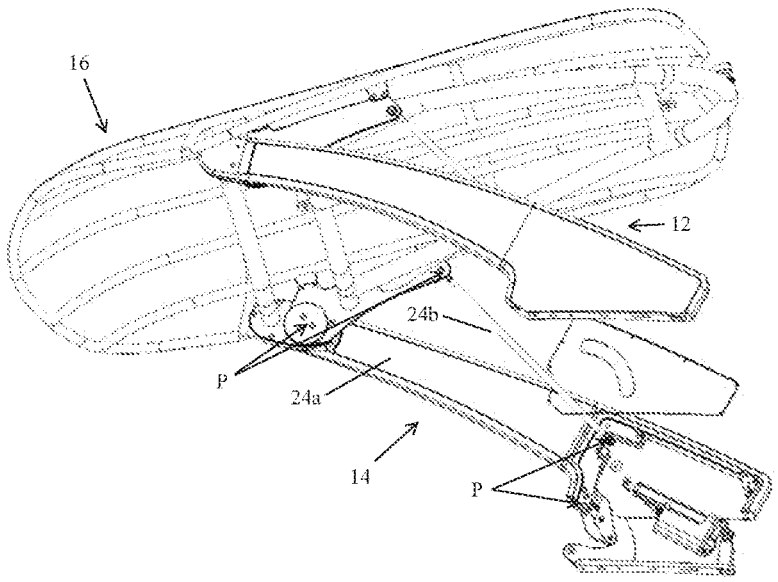
Figure 6:
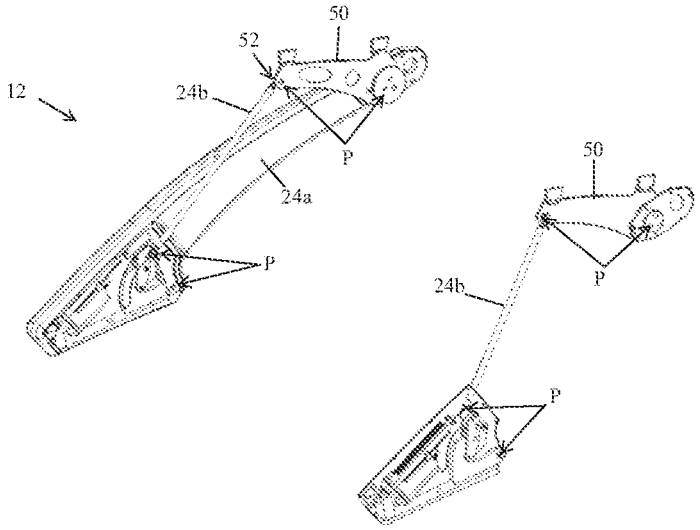
FIGS. 6-9 show components of leg structures of the tower of FIG. 1.
Figure 7:
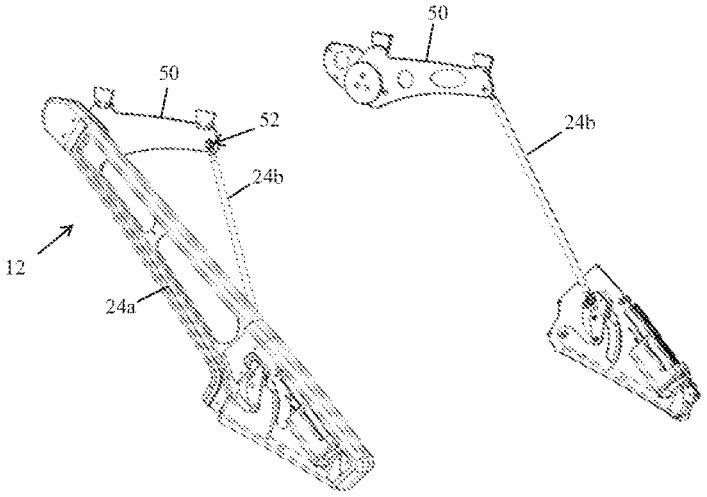
Figure 8:
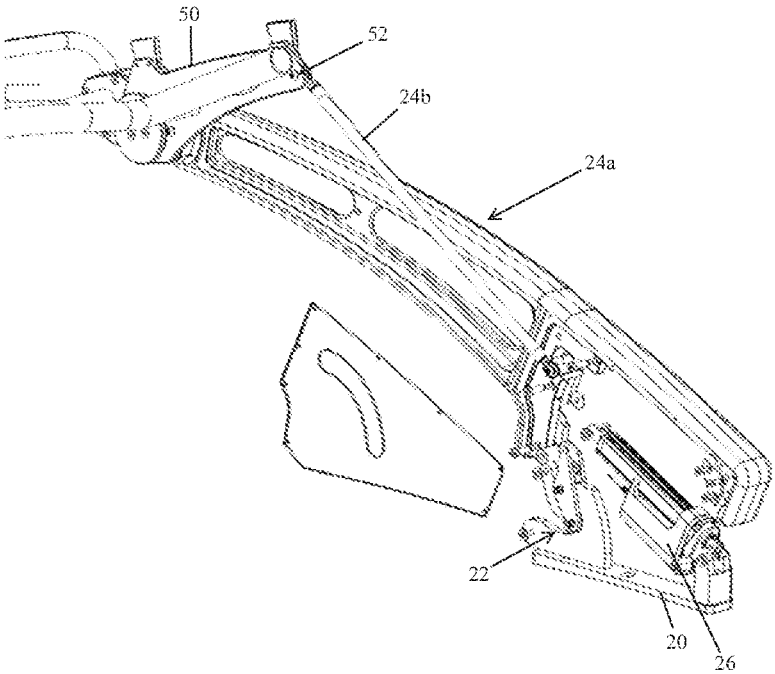
Figure 9:
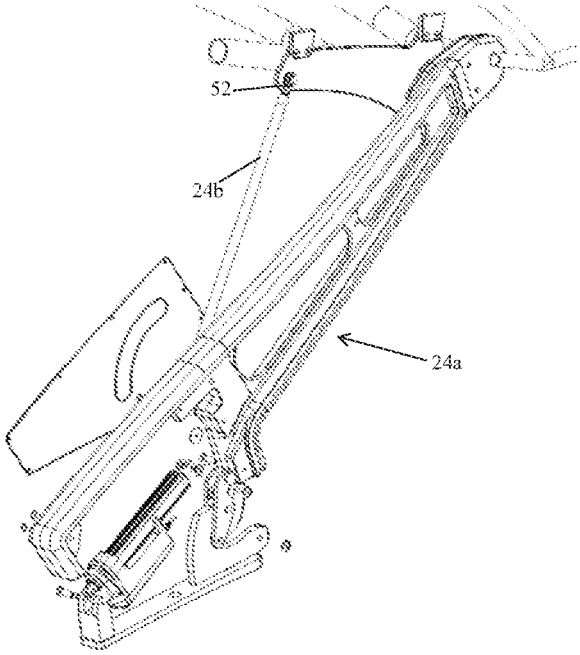
Figure 10:
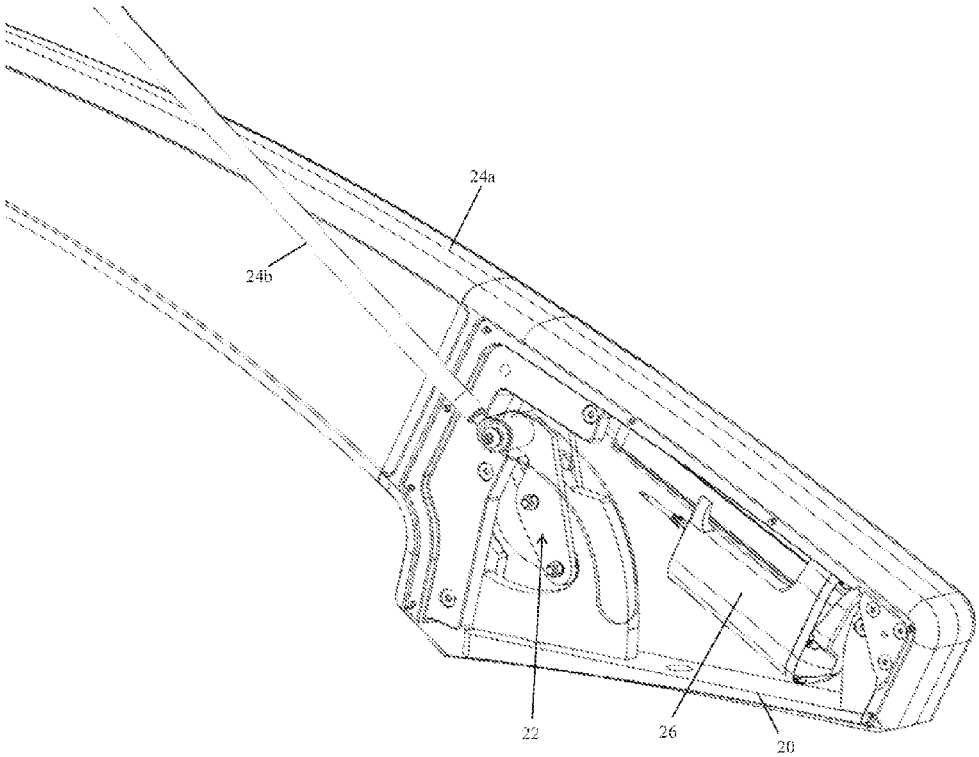
FIGS. 10-13 are detailed views of components of the leg structures of the tower of FIG. 1.
Figure 11:
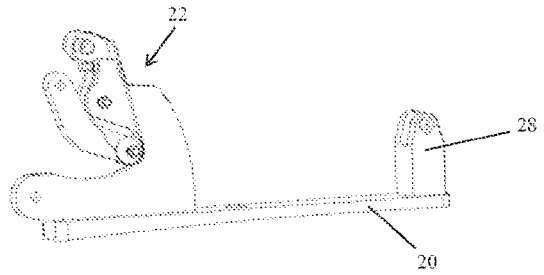
Figure 12:
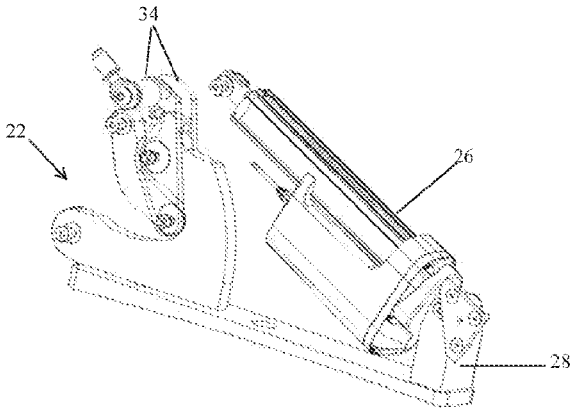
Figure 13:
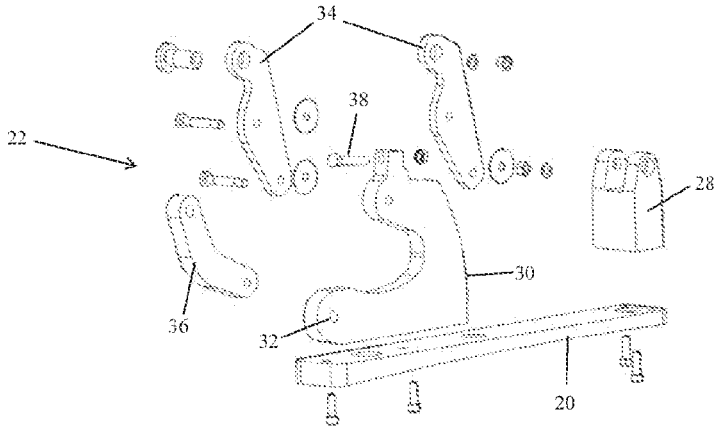

FIG. 3 shows the tower 10 in a fully lowered orientation. As will be observed, the cover frame 16 remains oriented in the same horizontal attitude A as in the fully elevated and partially elevated orientations, and without interfering with the windshield W, seating S, or other interior components of the boat B. This orientation is suitable for maximum coverage in the event of winds or stormy conditions. This orientation is also advantageous for trailering and storage of the boat, such as to allow egress into a garage, and also provides the benefit of providing support for a boat cover.

As described, the cover frame 16 remains oriented in the same attitude A throughout travel of the cover frame from the fully elevated orientation to the partially elevated orientation, and the fully lowered orientation, without interfering with the windshield W, seating S, or other interior components of the boat B. In this regard, the terminology "constant attitude," "the same attitude" or "the same horizontal attitude" will be understood to mean the attitude defined by an imaginary line extending along the longitudinal axis of the cover frame 16 and not deviating more than plus or minus about 5 degrees difference from the attitude of the cover frame 16. For example, in FIG. 1, the line A is oriented at 0 degrees. In FIG. 2, the line A is declined at about negative 1 degrees. In FIG. 3, the line A is declined at about negative 3 degrees. Accordingly, it will be understood that the cover frame 16 remains in a constant attitude or the same attitude when the attitude does not deviate more than plus or minus about 5 degrees.

With additional reference to FIGS. 4-10, the folding leg structures 12 and 14 are identical to one another, except the leg structure 12 is configured to be located on the port or left side of the boat, and the leg structure 14 is configured to be located on the starboard or right side of the boat. The leg structure 12 and the leg structure 14 each include a base 20 fixedly secured to the boat B, a hinge 22 mounted onto the base 20, and pivotably mounted leg sections 24*a* and 24*b*. The leg sections 24*a* and 24*b* are each pivotally mounted relative to the base 20 at spaced apart pivot points, and also to the cover frame 16 at spaced apart pivot points.

The lower end of the leg section 24*a* and the lower end of the leg section 24*b* are each pivotally mounted at spaced apart locations from one another so as to be able to pivot relative to the base 20. The leg sections 24*a* and 24*b* are each pivotal between an elevated orientation associated with the fully elevated orientation of the tower 10 and a lowered orientation associated with the fully folded orientation of the tower 10. The leg sections 24*a* and 24*b* may be made of various materials, such as aluminum framing, tubing, or the like having sufficient strength to serve as structural members of a wakeboard tower.

The hinge 22 is operable to pivotally position the leg section 24*a* relative to the base 20 and to maintain the leg section 24*a* at a desired position relative to the base 20. To enable powered positioning of the leg section 24*a* and to serve to maintain the leg section 24*a* at desired positions, an electrically powered linear actuator 26 is mounted between the base 20 and connected to the leg section 24*a*. The base 20 may be provided as by a metal plate or the like fixedly mounted as by fasteners to the hull of the boat B. The base 20 includes a mount 28 onto which a lower end of the linear actuator 26 is mounted.

The hinge 22 includes a hinge plate 30 fixedly mounted to the base 20. The hinge plate 30 includes a forward aperture 32 to which a lower end of the leg section 24*a* is pivotally mounted as by a fastener passing through apertures formed on the leg section 26 and the forward aperture 32 of the hinge plate 30. This provides a pivot point for the leg section 24*a*.

Figure 14:
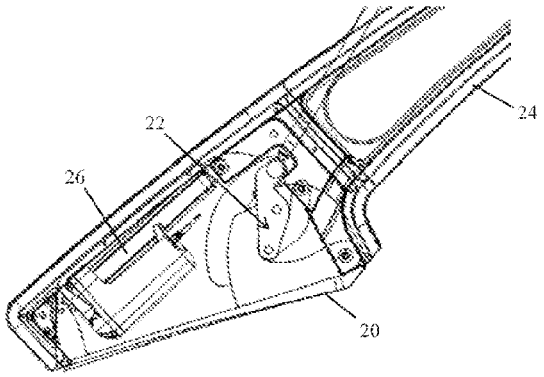
FIGS. 14-16 show the leg structure of the tower of FIG. 1 in the fully elevated, partially lowered, and fully lowered orientations, respectively.
Figure 15:
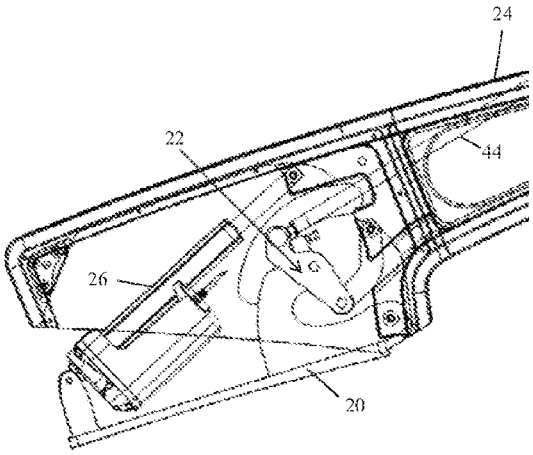
Figure 16:
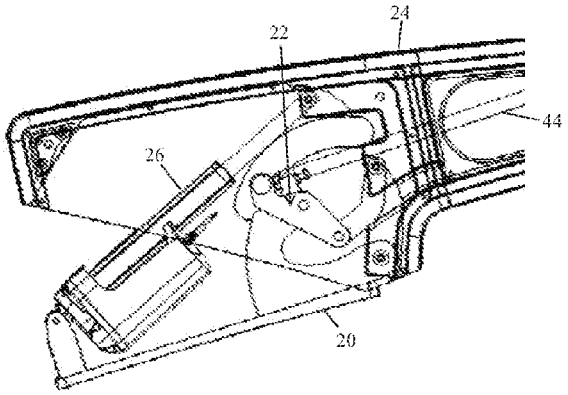
Figure 17:
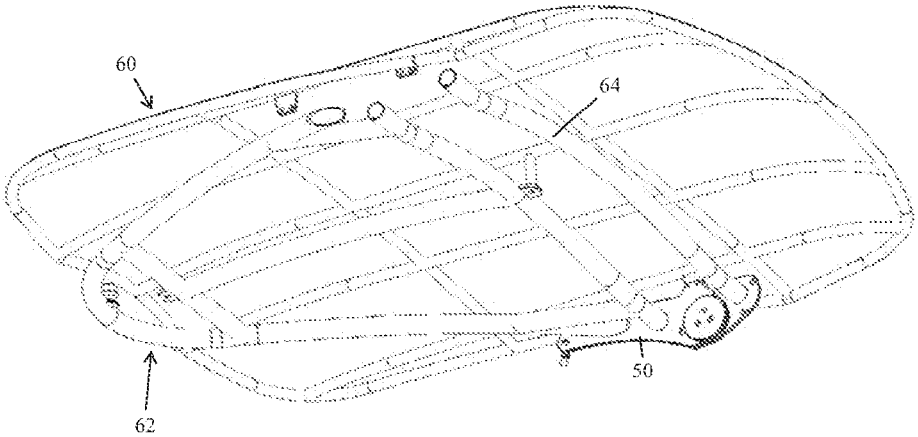
FIGS. 17-20 show components of a cover frame structure of the tower of FIG. 1.
Figure 18:
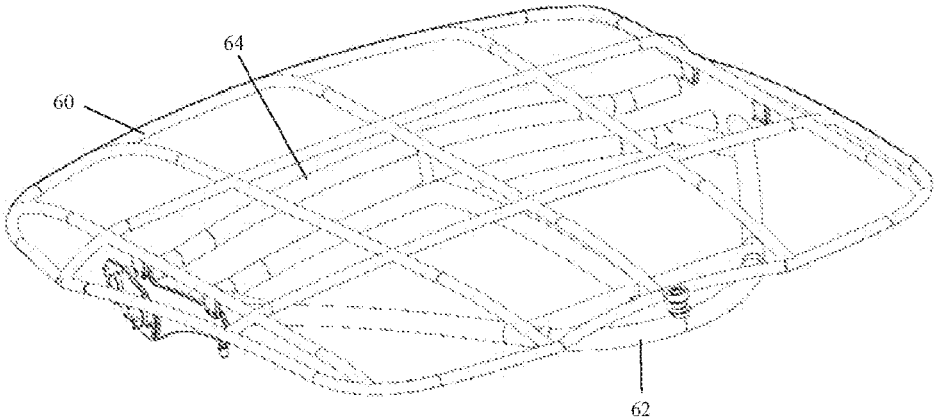
Figure 19:
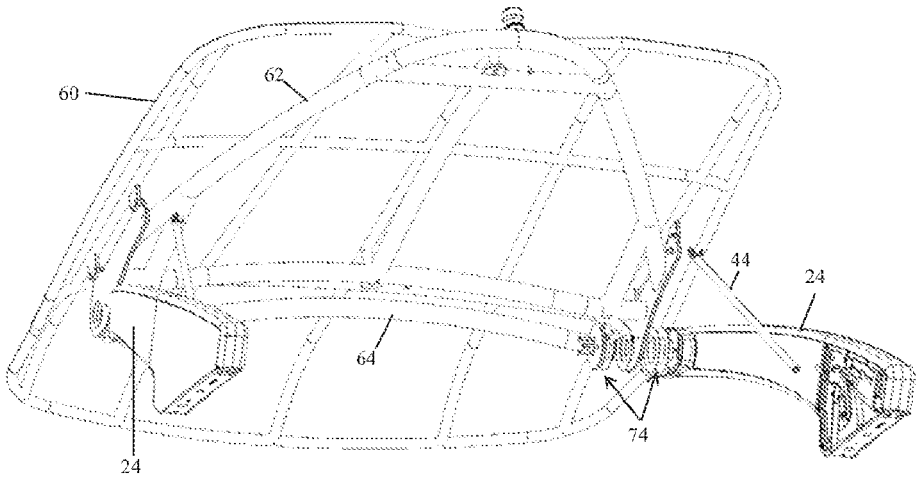
Figure 20:
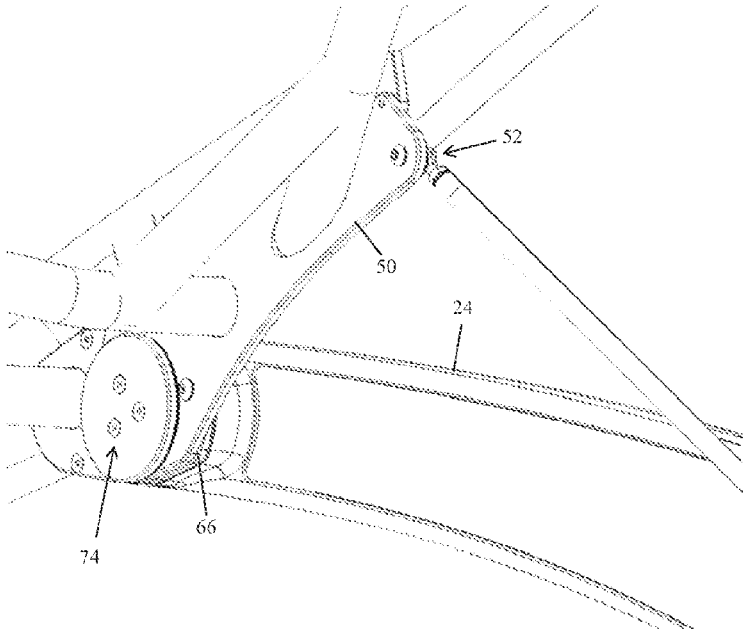
Figure 21:
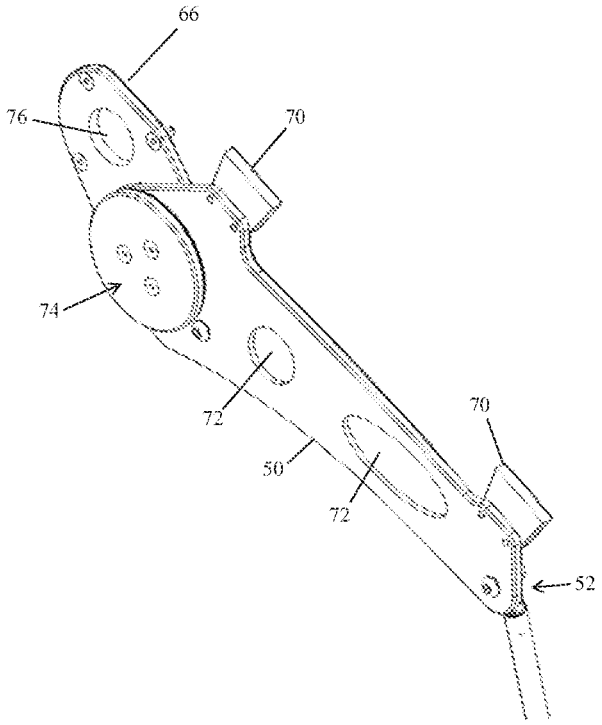
FIGS. 21-24 are detailed views of components of the cover frame structure of the tower of FIG. 1.

The hinge 22 also includes a pair of levers 34. The levers 34 are jointly and pivotally mounted to the hinge plate 30, and an arm 36 extends from and is pivotally mounted to an end of levers 34. A single lever 34 may be utilized, but a pair of levers 34 is preferred for strength. A stop 38 is adjustably mounted to the hinge plate 30 for positioning to abut an interior portion of the leg section 24*a* when the leg section 2*a*4 is in the fully elevated position. The stop 38 may be a bolt threadable into a threaded aperture of the hinge plate 30. As seen in FIGS. 14-16, a lower end of the leg section 24*a* pivotally connects to the hinge plate 30 that is fixedly mounted to the base 20, and an upper end of the linear actuator 26 connects to a portion of the lower end of the leg section 24*a*. A lower end of the leg section 24*b* is pivotally connected to the levers 34 of the hinge 22

As seen in FIGS. 1-3, an upper end of the leg section 24*a* is fixedly mounted to the cover frame 16. The cover frame 16 is connected to the leg section 24*a* by use of pivot mount having a pivot system 74 as described below. An upper end of the leg section 24*b* is pivotally connected to a frame base 50 of the cover frame 16 as by a pivot connector 52. The pivot system 74 and the pivot connector 52 are spaced apart from one another. The pivoting of the leg sections 24*a* and 24*b* are synched with the pivoting of the cover frame 16 to maintain the attitude of the cover frame 16.

The cover frame 16 includes an upper frame 60 that is preferably rigid and of fixed dimension in a shape configured to serve as a support for a sun cover. For example, the upper frame 60 may be made of small diameter welded aluminum tubing and configured generally as a rectangle to provide a generally planar structure that spans over the seating area S of the boat B.

The cover frame 16 also includes a lower frame 62 located below the upper frame 60 and configured to be sufficiently strong to serve as a wakeboard tower. For example, the upper frame 60 may be made of larger diameter welded aluminum tubing and configured to cooperate with the upper frame 60 to the tow point 18 and locations on which cargo such as wakeboards and the like may be stored. The upper frame 60 and the lower frame 62 are fixedly connected to one another and to the frame bases 50.

An arch 64 is connected to and spans between pivot mounts 66 pivotally connected to the opposing frame bases 50 and fixedly connected to the opposing leg sections 24*a* to provide an arch structure. Each pivot mount 66 enables the upper end of the leg section 24*a* to pivot relative to the frame base 50 as the leg section 24*a* moves between folded and unfolded orientations so as to permit the cover frame 16 to maintain a constant attitude.

Figure 22:
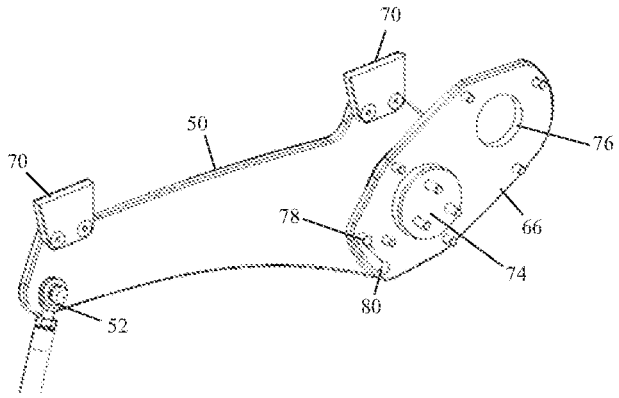

With reference to FIGS. 21-24, each frame base 50 of the cover frame 16 is configured to fixedly connect to the upper frame 60, the lower frame 62, and the arch 64. Each frame base 50 includes upper frame mounts 70 and lower frame receivers 72. The upper frame 60 is preferably fixedly connected to the upper frame mounts 70 as by fasteners. Ends of the lower frame 62 are preferably welded to the receivers 72. The pivot mounts 66 are pivotally connected to the frame bases 50 by pivot systems 74. The pivot mounts 66 are fixedly connectable to the upper ends of the leg sections 24*a* as by fasteners. Ends of the arch 64 are preferably welded to receivers 76 located on the pivot mounts 66. The range of pivot of the pivot mount 66 provided by the pivot system 74 relative to the frame base 50 is limited by a stop 78 located on the frame base 50 that cooperates with a slot 80 on the pivot mount 66 (FIG. 22).

The pivotal connection of the frame base 50 of the cover frame 16 to the leg sections 24 provides a pivotal mounting of the cover frame 16 relative to the leg section 24. The leg section 24*b* is also pivotally connected to the frame base 50 by a pivot connector or bearings or the like, and offset from the pivot system 74. Thus, it will be appreciated that the cover frame 16 is mounted by a pair of offset pivot points relative to the leg sections 24*a* and 24*b*, and pivots relative to the leg sections 24*a* and 24*b*.

Figure 23:
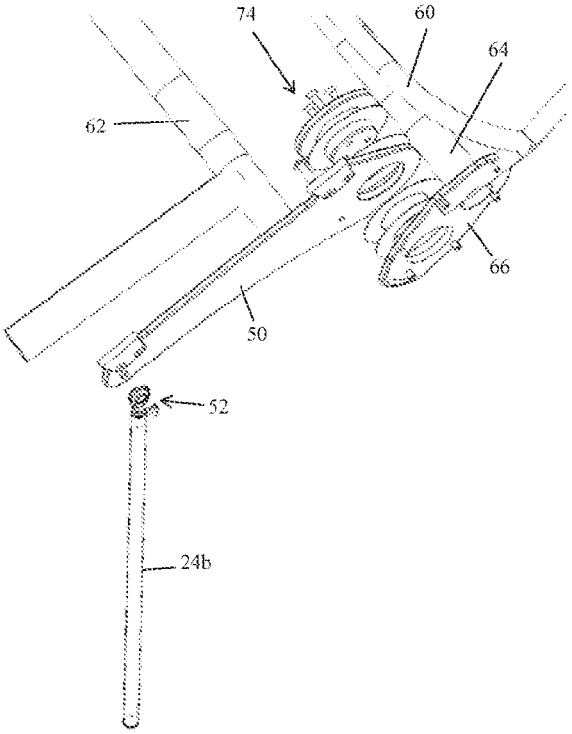
Figure 24:
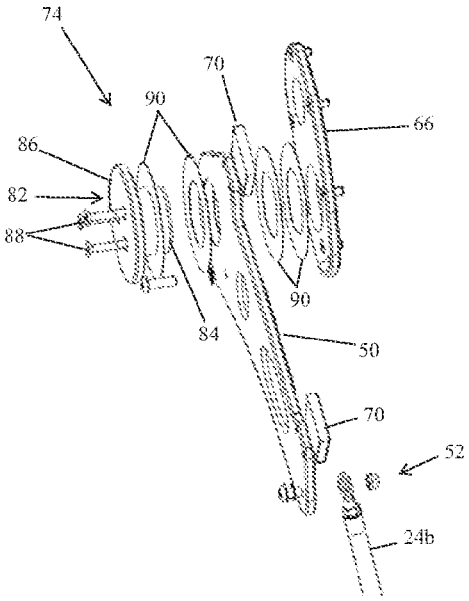

With additional reference to FIGS. 23 and 24, the pivot system 74 includes a cap 82 having a sleeve 84 that extends through aligned openings of the frame base 50 and the pivot mount 66. An enlarged end 86 of the cap 82 rests against the inner side of the frame base 50. The cap 82 includes longitudinal bores configured to receive fasteners 88. Heads of the fasteners 88 seat at the enlarged end 86, and the ends of the fasteners 88 thread or otherwise connect to the leg section 24*a* to secure the leg section 24*a* to the cap 82. Thin rings 90 of a low friction material, such as PTFE or other suitable material or bearings, seat onto the sleeve 84 and are located on either side of the frame base 50 to reduce friction and facilitate smooth pivoting or rotational movement of the leg section 24*a* relative to the frame base 50.

As previously described in connection with FIGS. 1-3, the tower 10 is advantageously configured to foldable to provide different configurations while maintaining the cover frame 16 in a constant attitude. This is enabled by the described structure, in which each of the legs 12 and 14 is pivotally mounted by a pair of offset pivot points, and each side the cover frame 16 is pivotally mounted by a pair of offset pivot points.

In operation of the tower 10, a user may change the tower 10 from the fully elevated orientation to the fully lowered orientation (or to orientations therebetween) by operating the linear actuator 26 to pull on a portion of a lower end of the leg section 24*a* of each of the legs 12 and 14. The operation of the linear actuator 26 for each of the legs 12 and 14 may be electronically controlled to be in synch with one another. As the leg section 24*a* pivots downwardly, and as controlled by the hinge 22 in response to the force exerted by the linear actuator 26, the leg section 24*b* controls the travel of the frame base 50 of the cover frame 16 relative to the hinge 22 so as to maintain the attitude of the frame base 50, and hence the attitude of the cover frame 16. In cooperation with this, the pivot system 74 pivots as the leg section 24*a* pivots so that the pivoting of the leg section 24*a* does not affect the attitude of the frame base 50 and the cover frame 16. Thus, the cover frame 16 remains in a constant attitude as the tower 10 travels from a raised position to a lowered position, as well as when traveling from the lowered position to the raised position. To accomplish this, the linear actuators 26 are simply reversed to raise the leg sections 24*a*.

Tower 100 Embodiment—FIGS. 25-40

With reference now to FIGS. 25-40, there is shown an alternate embodiment of a foldable watersports tower 100 according to the disclosure that is mountable on a boat having a seating area located generally behind and below a windshield.

The tower 100 includes, as major components, a pair of folding leg structures 102 and 104 mounted onto opposite sides of the boat B, and a cover frame 106 that cooperates with and spans between the leg structures 102 and 104 and functions to provide a raised arch structure for supporting a raised tow point 108.

A bimini or other sun cover as may be provided by a cloth or other flexible sheet material may be secured onto, preferably overlying, the cover frame 106, and without interfering with the tow point 108. The cover frame 106 with or without the sun cover is suitable for use for storing cargo, such as ski ropes, wakeboards, and other water sports equipment. For example, straps may be used to secure cargo on top of the cover frame 16 and/or racks and the like of the type typically installed onto wakeboard towers may be installed onto the cover frame 106.

The tower 100 is advantageously suitable to serve as both a watersports tower and provide support for a bimini cover, other sun or protective cover to protect occupants of the boat from the elements. Each of the leg structures 102 and 104 is pivotally mounted relative to the boat by a pair of offset pivot points, and each side the cover frame 106 is pivotally mounted to one of the legs by a pair of offset pivot points. The spaced apart pivot points for each of the leg structures 102 and 104 and the cover frame 106 described herein are denoted by the reference character P'.

Figure 25:
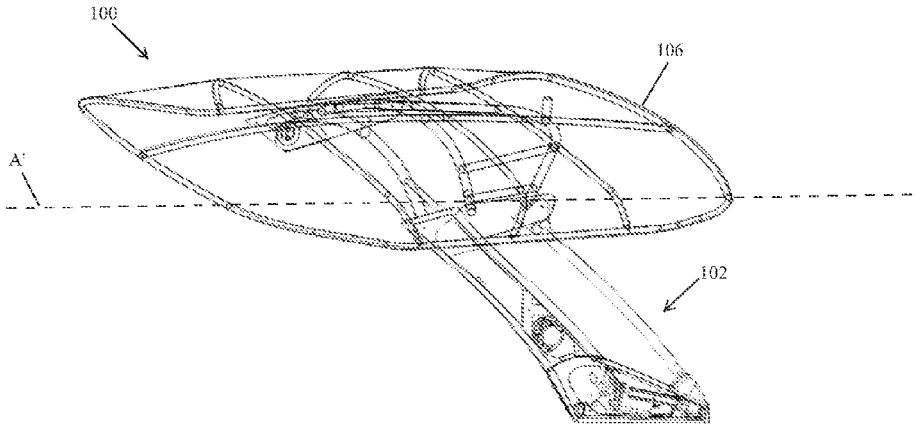
FIG. 25 shows a folding watersports tower according to another embodiment of the disclosure oriented in a fully elevated orientation.

The described structure having the noted pairs of spaced apart pivot points advantageously enables the tower 100 to be foldable to provide different elevations or configurations while maintaining the cover frame 106 in a constant attitude. For example, FIG. 25 shows the frame 100 in a fully elevated orientation. This orientation is preferred for use of the boat for wakeboarding and the like. As will be observed, the cover frame 106 is oriented in a horizontal attitude, as represented by the dashed line A'.

Figure 26:
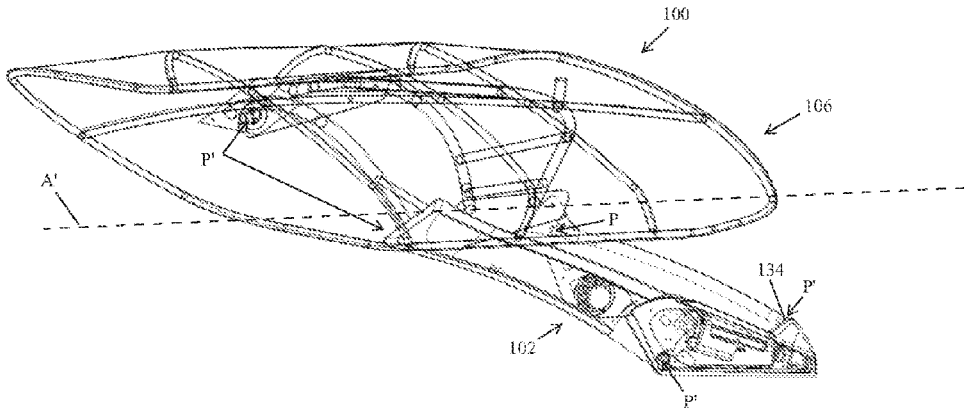
FIG. 26 shows the tower of FIG. 25 in a partially lowered orientation.

FIG. 26 shows the tower 100 in a partially lowered orientation. The cover frame 106 remains oriented in the same horizontal attitude A' as in the fully elevated orientation, and without interfering with the windshield, seating, or other interior components of the boat.

Figure 27:
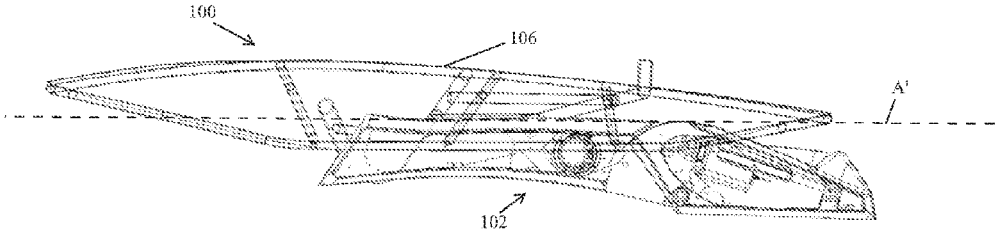
FIG. 27 shows the tower of FIG. 25 in a fully lowered orientation.
Figure 28:
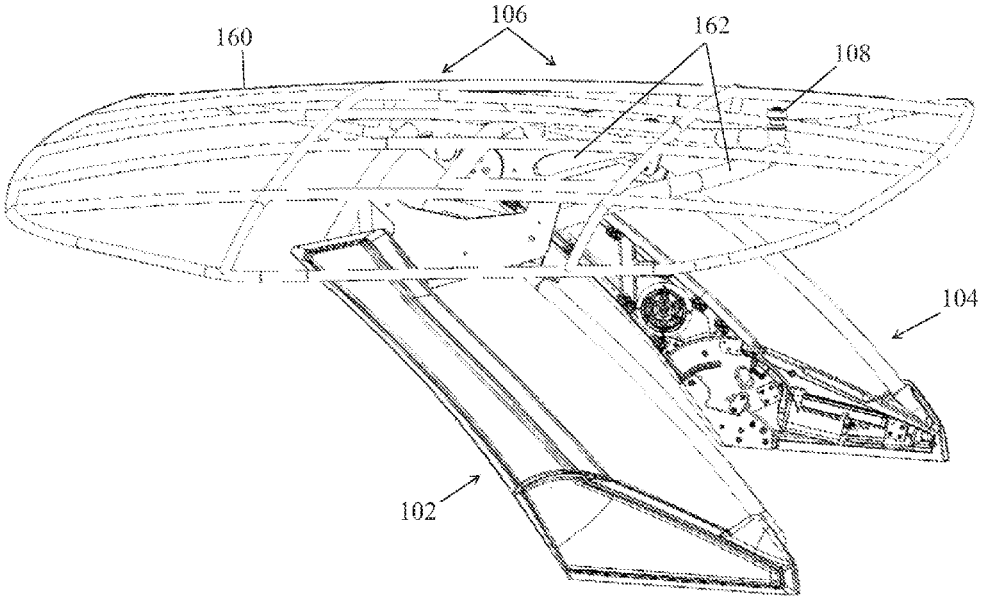
FIG. 28 is a perspective view of the tower of FIG. 25.
Figure 29:
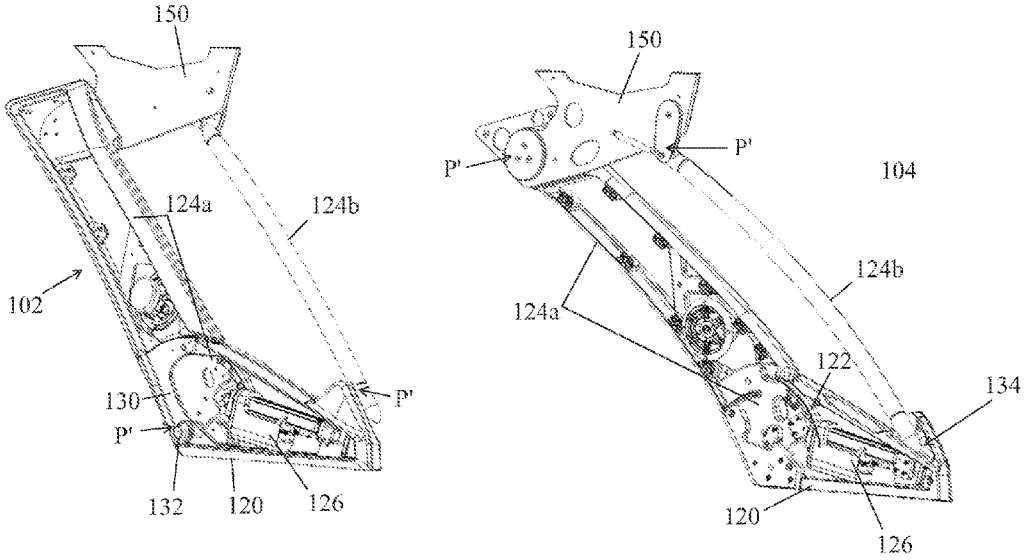
FIG. 29-30 show perspective views of the leg structures of the tower of FIG. 25.
Figure 30:
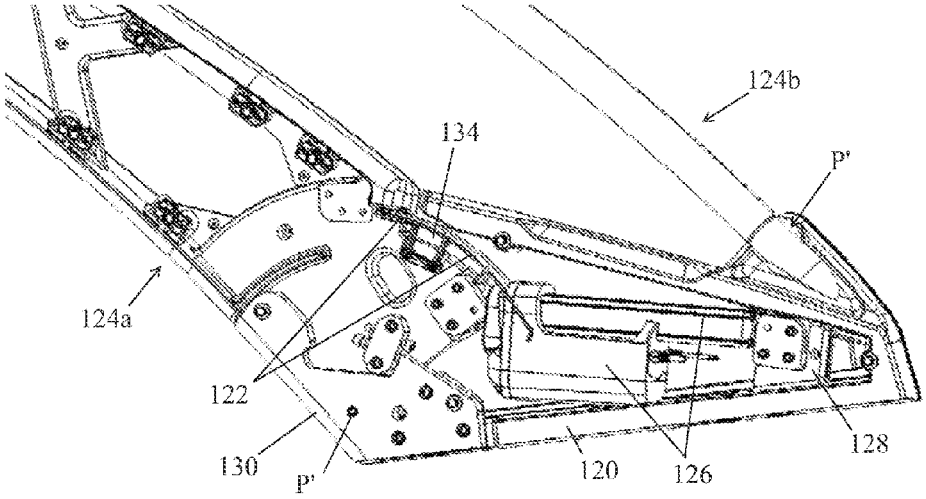
Figure 31:
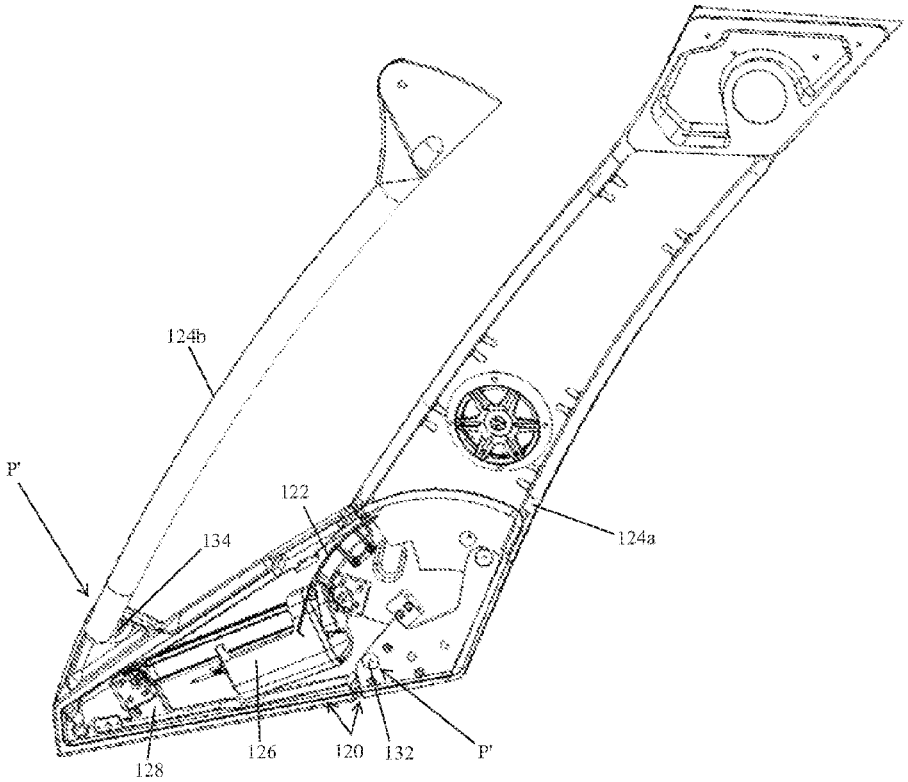
FIGS. 31-33 show the leg structure of the tower of FIG. 25 in the fully elevated, partially lowered, and fully lowered orientations, respectively.
Figure 32:
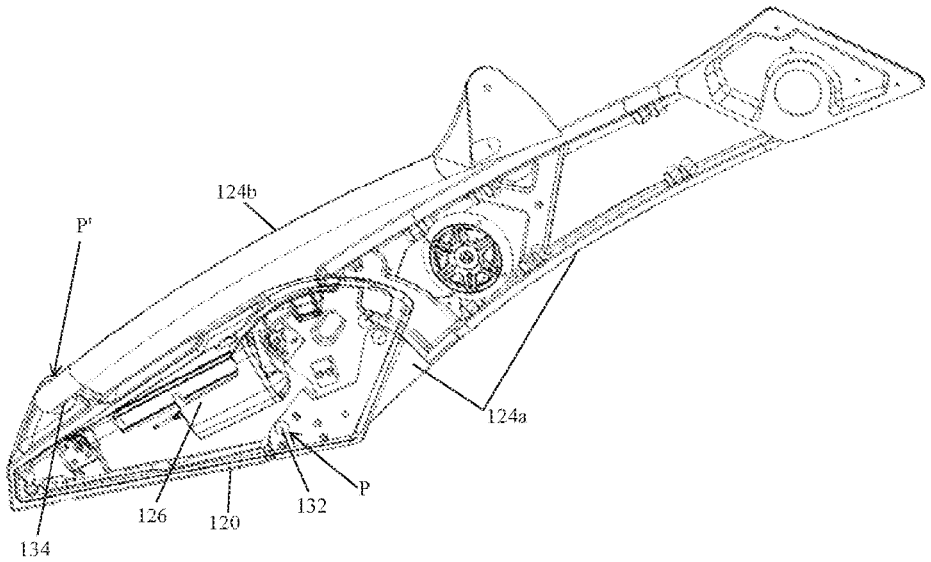
Figure 33:
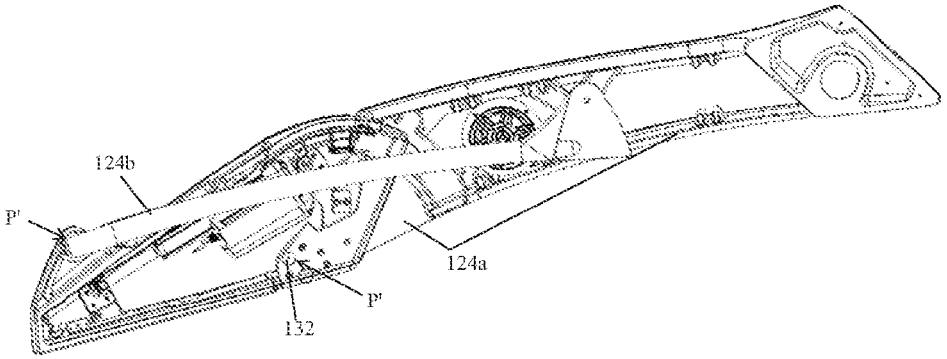
Figure 34:
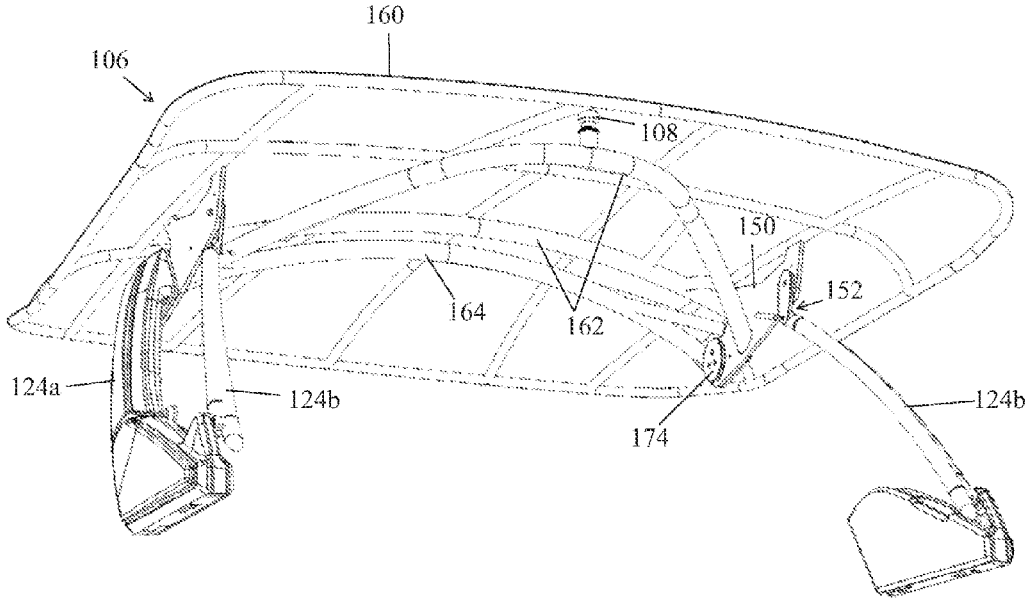
FIGS. 34-37 show components of a cover frame structure of the tower of FIG. 25.
Figure 35:
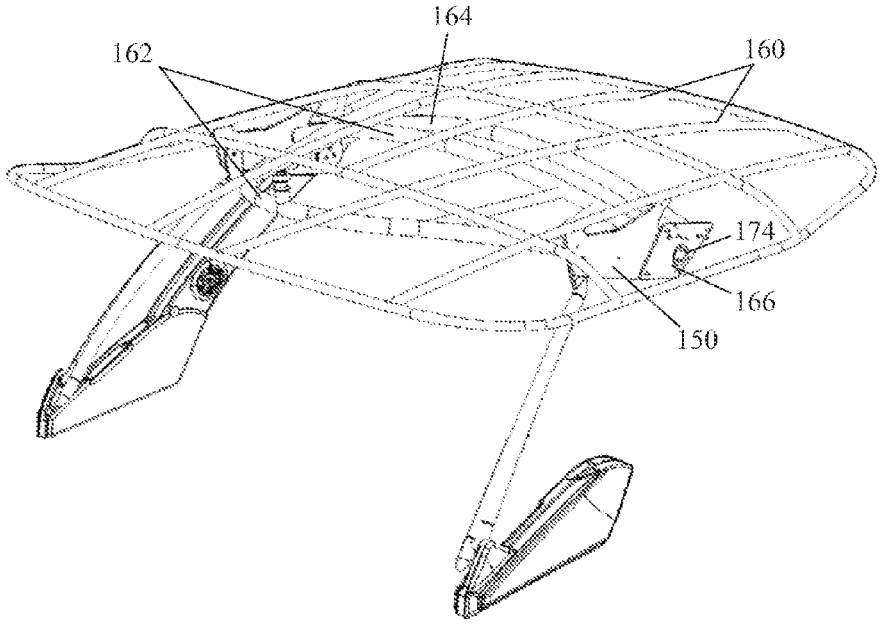
Figure 36:
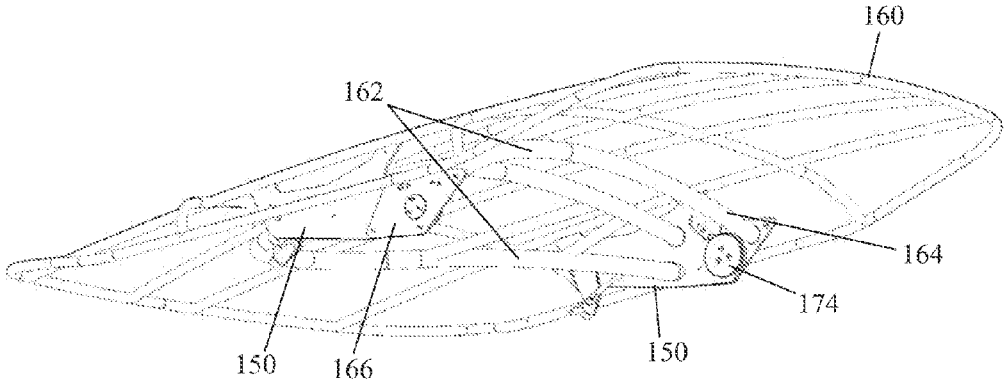
Figure 37:
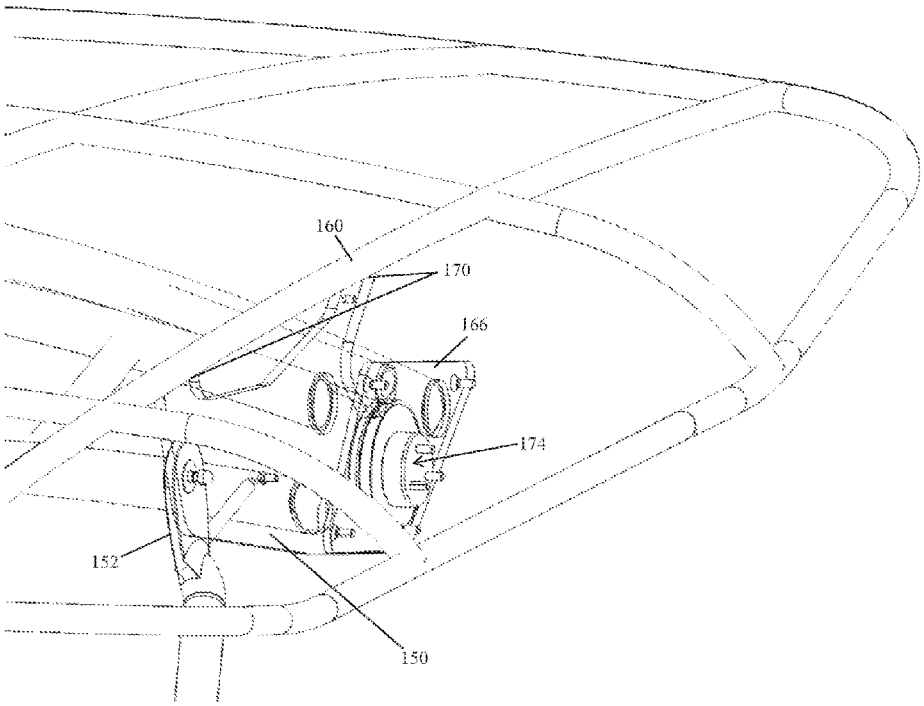
Figure 38:
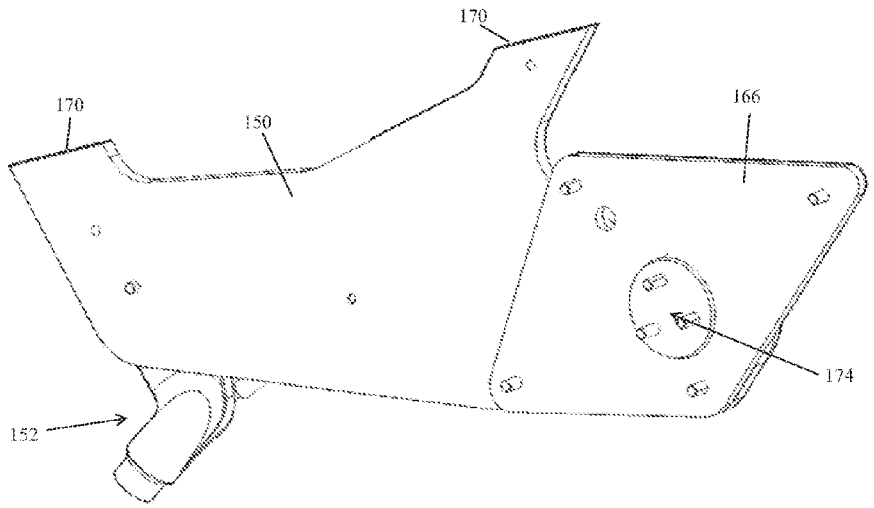
FIGS. 38-40 are detailed views of components of the cover frame structure of the tower of FIG. 25.
Figure 39:
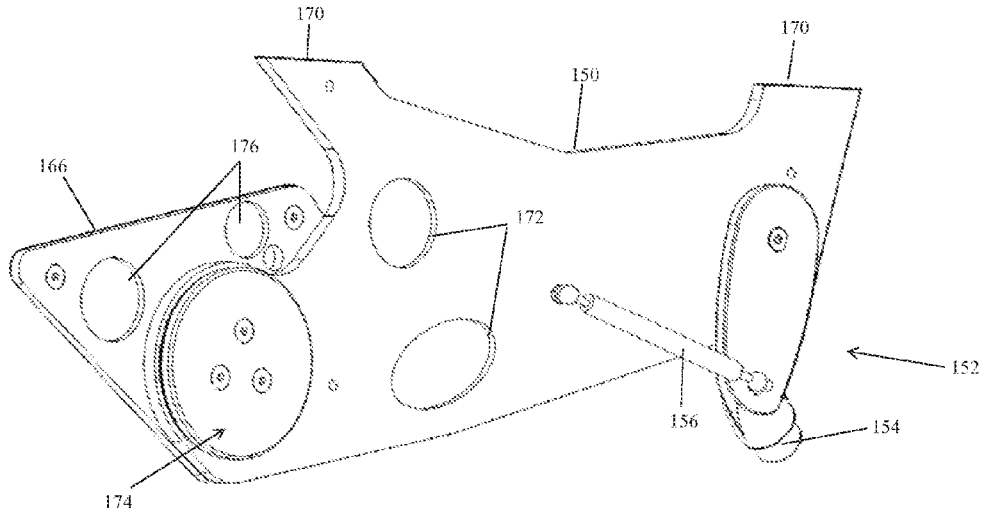

FIG. 27 shows the tower 100 in a fully lowered orientation. The cover frame 106 remains oriented in the same horizontal attitude A' without interfering with the windshield, seating, or other interior components of the boat.

With additional reference to FIGS. 29-36, the folding leg structures 102 and 104 are identical to one another, except the leg structure 102 is configured to be located on the port or left side of the boat, and the leg structure 104 is configured to be located on the starboard or right side of the boat. The leg structure 102 and the leg structure 104 each include a base 120 fixedly secured to the boat, a pivot guide 122 within the base 120, and pivotably mounted leg sections 124*a* and 124*b*.

As constructed, the lower end of the leg section 124*a* and the lower end of the leg section 124*b* are each pivotally mounted at spaced apart locations from one another so as to be able to pivot relative to the base 120. The leg sections 124*a* and 124*b* are each pivotal between an elevated orientation associated with the fully elevated orientation of the tower 100 and a lowered orientation associated with the fully folded orientation of the tower 100. The leg sections 124*a* and 124*b* may be made of various materials, such as aluminum framing, tubing, or the like having sufficient strength to serve as structural members of a wakeboard tower.

The pivot guide 122 may be provided as by an elongate and curved rigid metal or composite strip. The pivot guide 122 is connected to the leg section 124*a* as by fasteners and is curved to correspond with an interior surface of the base 120 to guide pivoting of the leg section 124*a*. An electrically powered linear actuator 126 is connected to a lower portion of the leg section 124*a*. The linear actuator 126 is mounted to the base 20 and connected to the leg section 124*a*.

The base 120 may be provided as by a metal or composite plate or the like fixedly mounted as by fasteners to the hull of the boat. The base 120 includes a mount 128 onto which a lower end of the linear actuator 126 is mounted. The base 120 also includes an upstanding portion 130 having a through aperture through which a fastener 132 or the like may be aligned with and passed through a corresponding aperture of a lower portion of the leg section 124*a* to pivotally mount the leg section 124*a* to the base 120. This provides a pivot point for the leg section 124*a*.

A lower end of the leg section 124*b* is pivotally connected at point 134 as by a pivot fastener or pin or the like to an upper portion of the base 120. This provides a pivot point for the lower end of the leg section 124*b* that is spaced apart from the pivot point for the lower end of the leg section 124*a*.

An upper end of the leg section 124*a* is fixedly mounted to the cover frame 106. The cover frame 106 is connected to the leg section 124*a* by use of pivot mount having a pivot system 174 as described below. An upper end of the leg section 124*b* is pivotally connected to a frame base 150 of the cover frame 106 as by a pivot connector 152. The pivot system 174 and the pivot connector 152 are spaced apart from one another. The pivoting of the leg sections 124*a* and 124*b* are synched with the pivoting of the cover frame 106 to maintain the attitude of the cover frame 106. The pivot connector 152 includes a leg receiver 154 pivotally mounted to the frame base 150 as by a fastener. In certain embodiments, a shock absorber 156 may be mounted between the frame base 150 and the pivot connector 154 to provide controlled resistance for controlling the rate of pivot of the pivot connector 154 for providing a smooth rate of pivot.

The cover frame 106 includes an upper frame 160 that is preferably rigid and of fixed dimension in a shape configured to serve as a support for a sun cover. For example, the upper frame 160 may be made of small diameter welded aluminum tubing and configured generally as a rectangle to provide a generally planar structure that spans over the seating area of the boat.

The cover frame 160 also includes a lower frame 162 located below the upper frame 160 and configured to be sufficiently strong to serve as a wakeboard tower. For example, the upper frame 160 may be made of larger diameter welded aluminum tubing and configured to cooperate with the upper frame 160 to the tow point 108 and locations on which cargo such as wakeboards and the like may be stored. The upper frame 160 and the lower frame 162 are not connected to one another, but each are connected to the frame bases 150.

An arch 164 is connected to and spans between pivot mounts 166 pivotally connected to the opposing frame bases 150 and fixedly connected to the opposing leg sections 124*a* to provide an arch structure. Each pivot mount 166 enables the upper end of the leg section 124*a* to pivot relative to the frame base 150 as the leg section 124*a* moves between folded and unfolded orientations so as to permit the cover frame 106 to maintain a constant attitude.

With reference to FIGS. 34-39, each frame base 150 of the cover frame 106 is configured to fixedly connect to the upper frame 160, the lower frame 162, and the arch 164. Each frame base 150 includes upper frame mounts 170 and lower frame receivers 172. The upper frame 160 is preferably fixedly connected to the upper frame mounts 170 as by fasteners. Ends of the lower frame 162 are preferably welded to the receivers 172. The pivot mounts 166 are pivotally connected to the frame bases 150 by pivot systems 174. The pivot mounts 166 are fixedly connectable to the upper ends of the leg sections 124*a* as by fasteners. Ends of the arch 164 are preferably welded to receivers 176 located on the pivot mounts 166.

The pivotal connection of the frame base 150 of the cover frame 106 to the leg sections 124 provides a pivotal mounting of the cover frame 106 relative to the leg sections 124. The leg section 124*b* is also pivotally connected to the frame base 150 by a pivot connector or bearings or the like, and offset from the pivot system 174. Thus, it will be appreciated that the cover frame 116 is mounted by a pair of offset pivot points relative to the leg sections 124*a* and 124*b*, and pivots relative to the leg sections 124*a* and 124*b*.

Figure 40:
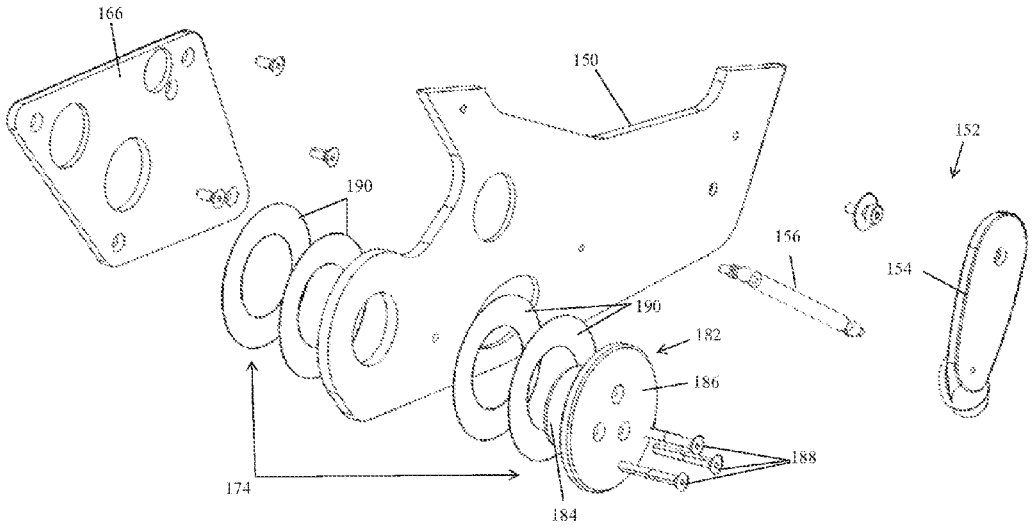

With additional reference to FIG. 40, the pivot system 174 includes a cap 182 having a sleeve 184 that extends through aligned openings of the frame base 150. An enlarged end 186 of the cap 182 rests against the inner side of the frame base 150. The cap 182 includes longitudinal bores configured to receive fasteners 188. Heads of the fasteners 188 seat at the enlarged end 186, and the ends of the fasteners 188 thread or otherwise connect to the leg section 124*a* to secure the leg section 124*a* to the cap 182. Thin rings 190 of a low friction material, such as PTFE or other suitable material or bearings, seat onto the sleeve 184 and are located on either side of the frame base 150 to reduce friction and facilitate smooth pivoting or rotational movement of the leg section 124*a* relative to the frame base 150.

As previously described in connection with FIGS. 25-27, the tower 100 is advantageously configured to foldable to provide different configurations while maintaining the cover frame 106 in a constant attitude. This is enabled by the described structure, in which each of the legs 102 and 104 is pivotally mounted by a pair of offset pivot points, and each side the cover frame 106 is pivotally mounted by a pair of offset pivot points.

In operation of the tower 100, a user may change the tower 100 from the fully elevated orientation to the fully lowered orientation (or to orientations there between) by operating the linear actuator 126 to pull on a portion of a lower end of the leg section 24*a* of each of the legs 102 and 104. The operation of the linear actuator 126 for each of the legs 102 and 104 may be electronically controlled to be in synch with one another. As the leg section 24*a* pivots downwardly in response to the force exerted by the linear actuator 126, the leg section 124*b* controls the travel of the frame base 150 of the cover frame 106 so as to maintain the attitude of the frame base 150, and hence the attitude of the cover frame 106. In cooperation with this, the pivot system 174 pivots as the leg section 124*a* pivots so that the pivoting of the leg section 124*a* does not affect the attitude of the frame base 150 and the cover frame 106. Thus, the cover frame 106 remains in a constant attitude as the tower 100 travels from a raised position to a lowered position, as well as when traveling from the lowered position to the raised position. To accomplish this, the linear actuators 126 are simply reversed to raise the leg sections 124*a*.

Figure 41:
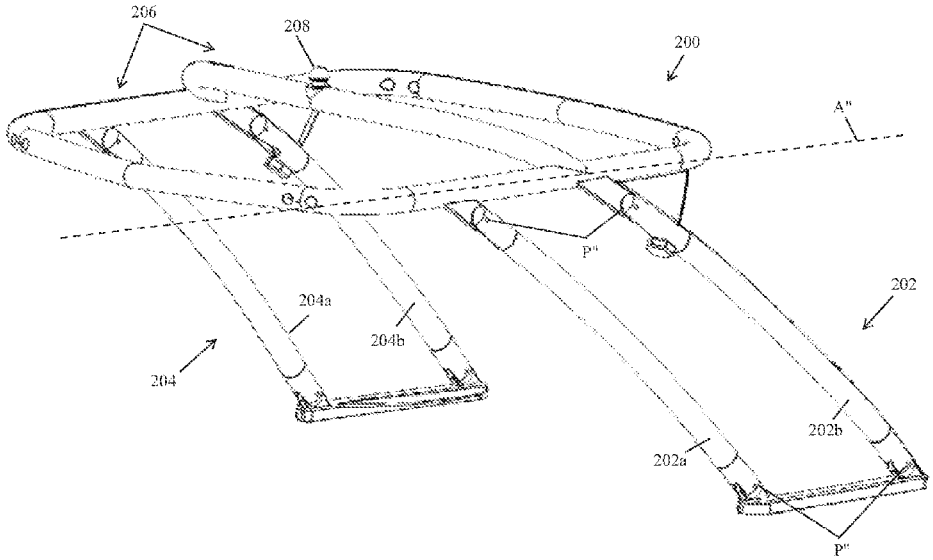
FIG. 41 shows a folding watersports tower according to yet another embodiment of the disclosure oriented in a fully elevated orientation.
Figure 42:
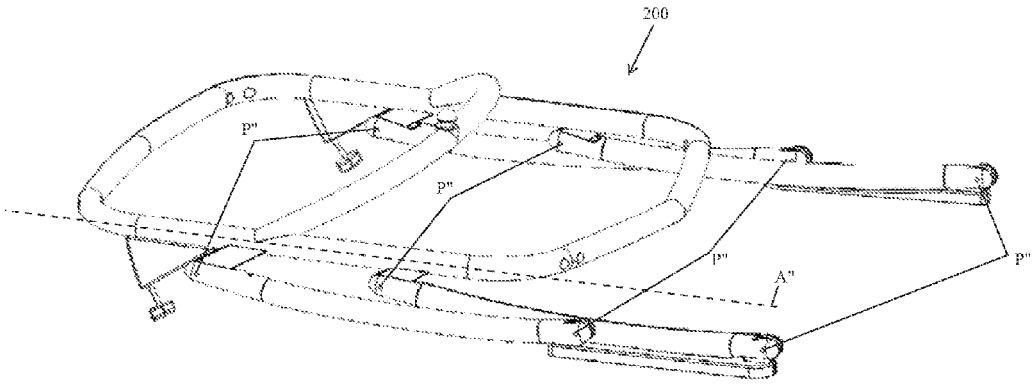
FIG. 42 shows the tower of FIG. 40 in a fully lowered orientation.

Tower 200 Embodiment—FIGS. 41-42

With reference now to FIGS. 41-42, there is shown an alternate embodiment of a foldable watersports tower 200 according to the disclosure that is mountable on a boat having a seating area located generally behind and below a windshield.

The tower 200 includes, as major components, a leg 202 provided by a pair of folding leg sections 202*a* and 202*b*, and a leg 204 provided by a pair of folding leg sections 204*a* and 204*b*. A cover frame 206 cooperates with and spans between the legs 202 and 204 and functions to provide a raised arch structure for supporting a raised tow point 208. The tower 200 is advantageously suitable to serve as both a watersports tower and provide support for a bimini cover, other sun cover.

Each of the legs 202 and 204 is pivotally mounted relative to the boat by a pair of offset pivot points, and each side the cover frame 206 is pivotally mounted to one of the legs by a pair of offset pivot points. The pivot points are indicted by the reference numeral P". This structure advantageously enables the tower 200 to be foldable to provide different configurations while maintaining the cover frame 206 in a constant attitude.

For example, FIG. 41 shows the frame 200 in a fully elevated orientation. This orientation is preferred for use of the boat for wakeboarding and the like. As will be observed, the cover frame 106 is oriented in a horizontal attitude, as represented by the dashed line A".

FIG. 42 shows the tower 200 in a fully lowered orientation. The cover frame 206 remains oriented in the same horizontal attitude A" without interfering with the windshield, seating, or other interior components of the boat.

The tower 200 is manually operated in that it does not incorporate electronic actuators. Thus, each of the pivot points P may include a set screw or other lock structure that may be loosened to permit desired pivotal motion for raising or lowering the tower 200. Then, the set screws may be tightened to lock the position of the tower 200.

Accordingly, the disclosure advantageously provides folding watersports tower structures that incorporate a sun cover structure, and are foldable to provide different configurations while maintaining the sun cover structure in a constant attitude.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A foldable tower mountable on a boat and suitable to provide support for a sun cover, the tower comprising:

a cover frame including a raised tow point extending therefrom;

a first leg supporting the cover frame, the first leg comprising:

a first leg section having a lower end and an upper end, the lower end of the first leg section being pivotally mountable adjacent the boat at a first lower pivot location, and the upper end of the first leg section being pivotally connected to the cover frame at a first upper pivot location, and a second leg section having a lower end and an upper end, the lower end of the second leg section being pivotally mountable adjacent the boat at a second lower pivot location that is spaced apart from the first lower pivot location, and the upper end of the second leg section being pivotally connected to the cover frame at a second upper pivot location that is spaced apart from the first upper pivot location;

wherein the tower is foldable so as to be raisable and lowerable between a raised position and a lowered position and the cover frame remains in a constant attitude as the tower travels between the raised position and the lowered position.

2. The tower of claim 1, further comprising a linear actuator located to act upon the lower end of the first leg section so that the actuator may push against the lower end of the first leg section to pivot the first leg section downwardly, and the actuator may pull on the lower end of the first leg section to pivot the first leg section upwardly.

3. The tower of claim 1, further comprising a second leg supporting the cover frame and spaced apart from the first leg.

4. The tower of claim 1, wherein the cover frame includes an upper frame configured to serve as a support for a sun cover, and a lower frame located below the upper frame and configured to be sufficiently strong to serve as a wakeboard tower and having the tow point thereon.

5. The tower of claim 1, wherein the cover frame remains in a constant attitude when the attitude does not deviate more than plus or minus 5 degrees.

6. The tower of claim 1, wherein the cover frame includes a frame base and a pivot base pivotally connected to the frame base.

7. A foldable tower mountable on a boat and suitable to provide support for a sun cover, the tower comprising:

a cover frame having a frame base and a pivot base pivotally connected to the frame base;

a leg supporting the cover frame, the leg comprising:

a first leg section having a lower end and an upper end, the lower end of the first leg section being pivotally mountable adjacent the boat at a first lower pivot location, and the upper end of the first leg section being connected to the pivot base of the cover frame at a first upper pivot location, and a second leg section having a lower end and an upper end, the lower end of the second leg section being pivotally mountable adjacent the boat at a second lower pivot location that is spaced apart from the first lower pivot location, and the upper end of the second leg section being pivotally connected to the frame base of the cover frame at a second upper pivot location that is spaced apart from the first upper pivot location;

wherein the tower is foldable so as to be raisable and lowerable between a raised position and a lowered position and the cover frame is capable of remaining in a constant attitude as the tower travels between the raised position and the lowered position.

8. A foldable tower mountable on a boat and suitable to provide support for a sun cover, the tower comprising:

a sun cover frame;

a tow point extending from the tower for use in water-sports towing;

a first leg supporting the cover frame, the first leg comprising:

a first leg section having a lower end and an upper end, the lower end of the first leg section being pivotally mountable adjacent the boat at a first lower pivot location, and the upper end of the first leg section being pivotally connected to the cover frame at a first upper pivot location, and a second leg section having a lower end and an upper end, the lower end of the second leg section being pivotally mountable adjacent the boat at a second lower pivot location, and the upper end of the second leg section being pivotally connected to the cover frame at a second upper pivot location;

wherein the tower is foldable so as to be raisable and lowerable between a raised position and a lowered position.

9. The tower of claim 8, wherein the cover frame is capable of remaining in a constant attitude as the tower travels between the raised position and the lowered position.

10. The tower of claim 9, wherein the cover frame remains in a constant attitude such that the attitude does not deviate more than plus or minus 5 degrees.

11. The tower of claim 8, further comprising a linear actuator located to act upon the lower end of the first leg section so that the actuator may push against the lower end of the first leg section to pivot the first leg section downwardly, and the actuator may pull on the lower end of the first leg section to pivot the first leg section upwardly.

12. The tower of claim 8, further comprising a second leg supporting the cover frame and spaced apart from the first leg.

13. The tower of claim 8, wherein the sun cover frame includes an upper frame configured to serve as a support for a sun cover, and a lower frame located below the upper frame and configured to be sufficiently strong to serve as a wakeboard tower and having the tow point thereon.

14. The tower of claim 8, wherein the second lower pivot location is spaced apart from the first lower pivot location.

15. The tower of claim 8, wherein the second upper pivot location is spaced apart from the first upper pivot location.

16. The tower of claim 8, wherein the first lower pivot location or the second lower pivot location are moveable in relation to the boat.

* * * * *